US005415410A

United States Patent [19]

Aoyama

[11] Patent Number: 5,415,410

[45] Date of Patent: May 16, 1995

[54] THREE PARTING LINE QUADRILATERAL GOLF BALL DIMPLE PATTERN

[75] Inventor: Steven Aoyama, Marion, Mass.

[73] Assignee: Acushnet Company, New Bedford, Mass.

[21] Appl. No.: 193,495

[22] Filed: Feb. 7, 1994

[51] Int. Cl.[6] ..... A63B 37/14

[52] U.S. Cl. ..... 273/232

[58] Field of Search ..... 273/232, 62, 213

[56] References Cited

U.S. PATENT DOCUMENTS 4,960,281 10/1990 Aoyama ..... 273/232

5,145,180 9/1992 Oka ..... 273/232

FOREIGN PATENT DOCUMENTS 2243555 6/1991 United Kingdom ..... 273/232

*Primary Examiner*—George J. Marlo

*Attorney, Agent, or Firm*—Pennie & Edmonds

[57] ABSTRACT

A golf ball having a spherical surface with a plurality of dimples formed therein, the spherical surface comprising eight spherical triangles delineated by three great circle parting lines not intersecting any dimples, said parting lines being formed by projecting the edges of an inscribed regular octahedron onto said spherical surface, each of said triangles having dimples located within such parting lines such that a) the division of each triangle by three division lines angularly spaced at 120 degrees from one another and originating at the center of each triangle forms three spherical guadrilaterals each having identical dimple patterns; and b) each of said patterns is not bilaterally symmetrical across any apex line extending from the center of the triangle to an apex of the triangle.

6 Claims, 7 Drawing Sheets

THREE PARTING LINE QUADRILATERAL GOLF BALL DIMPLE PATTERN

BACKGROUND OF THE INVENTION

Golf ball dimple patterns based on the use of three great circle parting lines are old. The octahedron Atti pattern, which was a standard for years, is an example of the use of three parting lines. One of the drawbacks of such patterns is that many dimples placed within the pattern normally follow triangular patterns resulting in aligned rows of dimples which can provide poor flight characteristics. (See U.S. Pat. No. 4,960,281 describing dimple non-alignment).

Prior balls using the octahedron pattern have placed dimples in each spherical triangle such that there is bilateral symmetry across apex lines from the center to an apex of the spherical triangle.

SUMMARY OF THE INVENTION

Broadly, the present invention comprises a golf ball dimple pattern in which the surface of the ball is divided by three great circle parting lines into eight spherical triangles each of which triangles so formed is, in turn, divided using division lines into three spherical quadrilaterals resulting in a total of twenty-four quadrilaterals on the spherical surface. Dimples are placed on the ball surface to avoid symmetry across apex lines without any dimples intersecting the parting lines and with no dimples intersecting the division lines unless they are bisected or trisected by the division lines.

It is preferred that dimples arranged within each of the quadrilaterals are not generally formed in triangular patterns or aligned rows.

DESCRIPTION OF THE PREFERRED EMBODIMENT OF THE INVENTION

Figure 1:
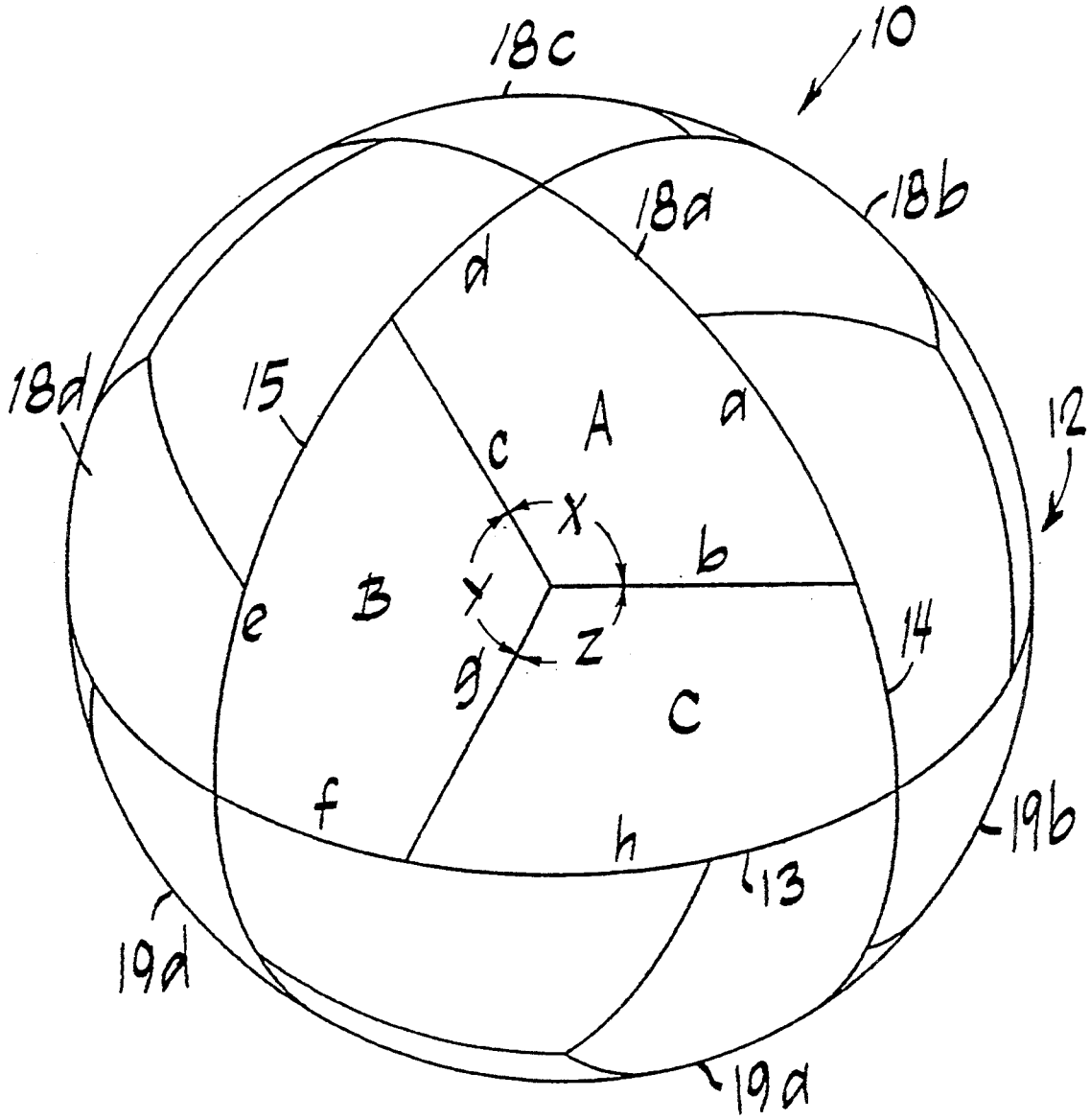
FIG. 1 is an isometric view of the golf ball of the present invention divided by three parting lines into eight (8) triangles and further divided into twenty-four (24) quadrilaterals.

In FIGS. 1–4, golf ball 10 has a dimple pattern 11 formed by projecting an octahedron (not shown) onto a spherical surface 12 determined by the diameter of ball 10. Surface 12 is initially divided by three great circle parting lines 13, 14 and 15 projected from the edges of a regular octahedron inscribed inside spherical surface 12 (which octahedron is not shown in the figures) to form eight (8) spherical triangles; four (4) triangles 18*a–d* in the upper hemisphere and four (4) triangles 19*a–d* in the lower hemisphere (19*c* is not visible). Parting line 13 is the equatorial line. Each triangle 18*a–d*, 19*a–d* is in turn divided into three (3) identical spherical quadrilaterals A, B and C. The angle between division lines or sides c and b is 120 degrees. Sides d and a are not equal in this embodiment. Angles x, y and z formed at the intersection of sides c, b and g are each 120 degrees (FIG. 1).

Figure 2:
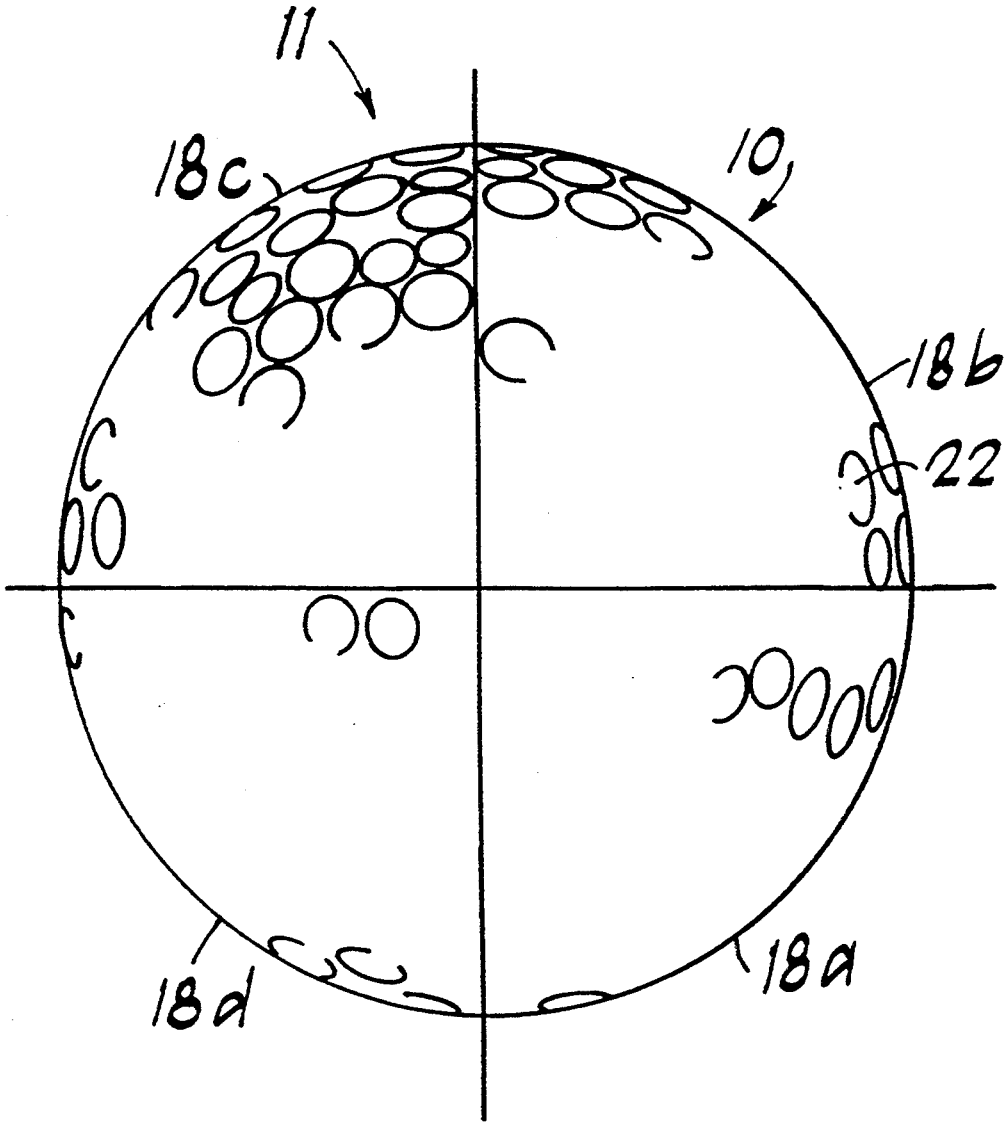
FIG. 2 is a plan view of a 456 dimple version of the ball.
Figure 3:
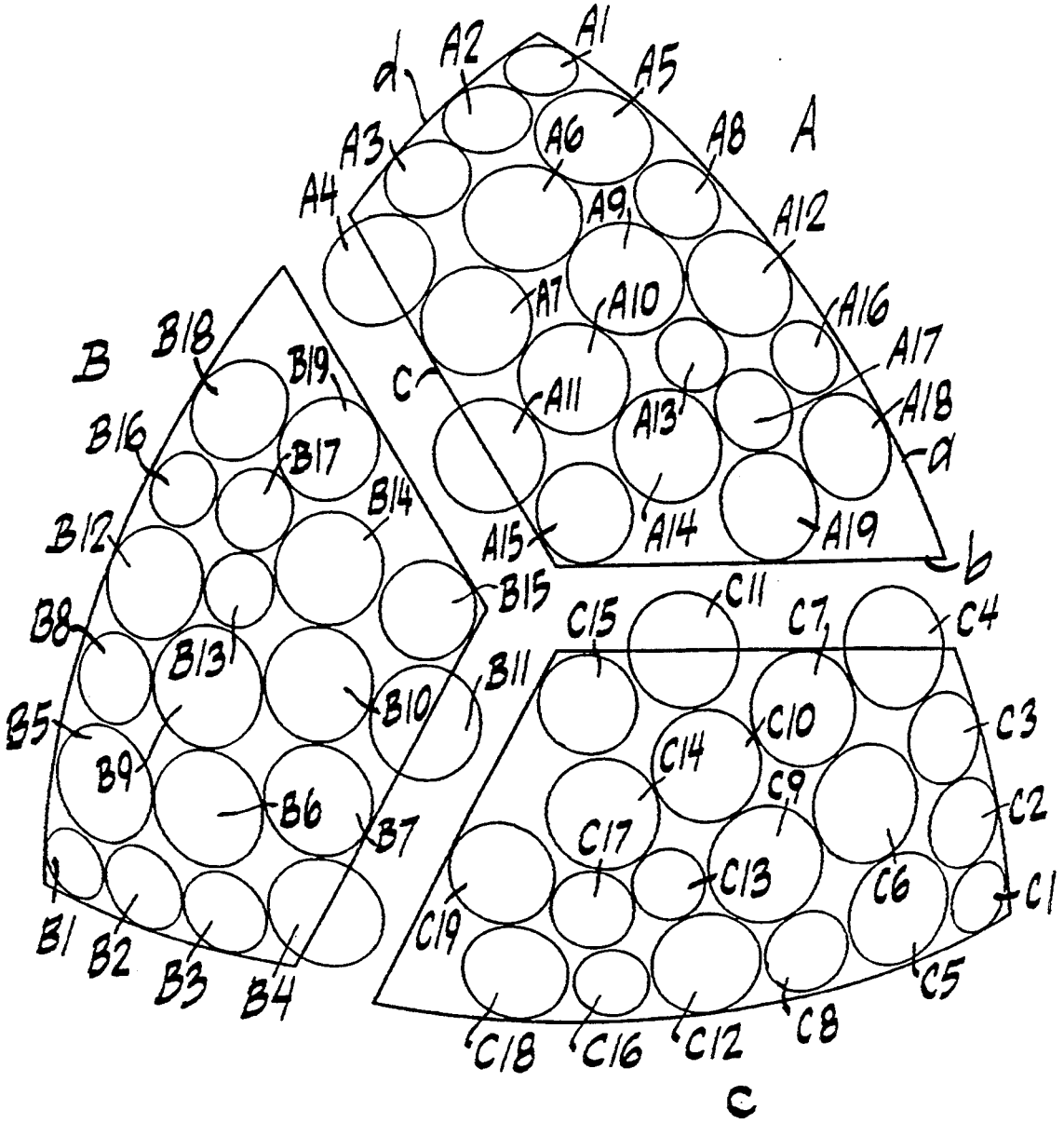
FIG. 3 is an exploded view of one of the triangles showing its division in turn into three quadrilaterals.
Figure 4:
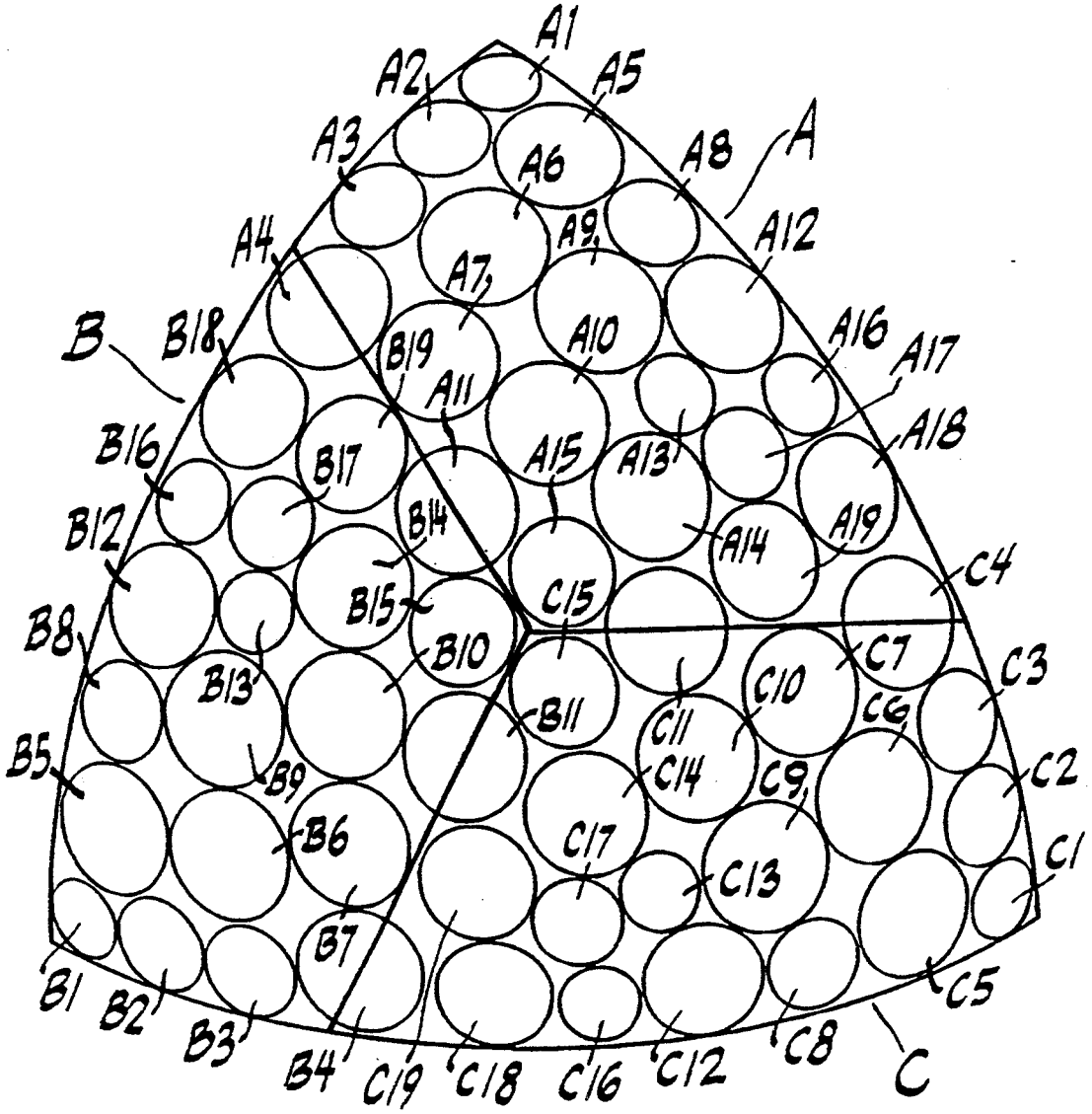
FIG. 4 is a view of the triangle of FIG. 3 closed up.

Turning to FIGS. 2–4, ball 10 has 456 dimples of varying diameters, as set forth in the following table:

TABLE I

| Number of Dimples | Dimple Diameter |
|---|---|
| 72 | .100 in. |
| 24 | .110 in. |
| 72 | .120 in. |
| 24 | .130 in. |
| 48 | .140 in. |
| 120 | .150 in. |
| 96 | .160 in. |

Figure 4A:
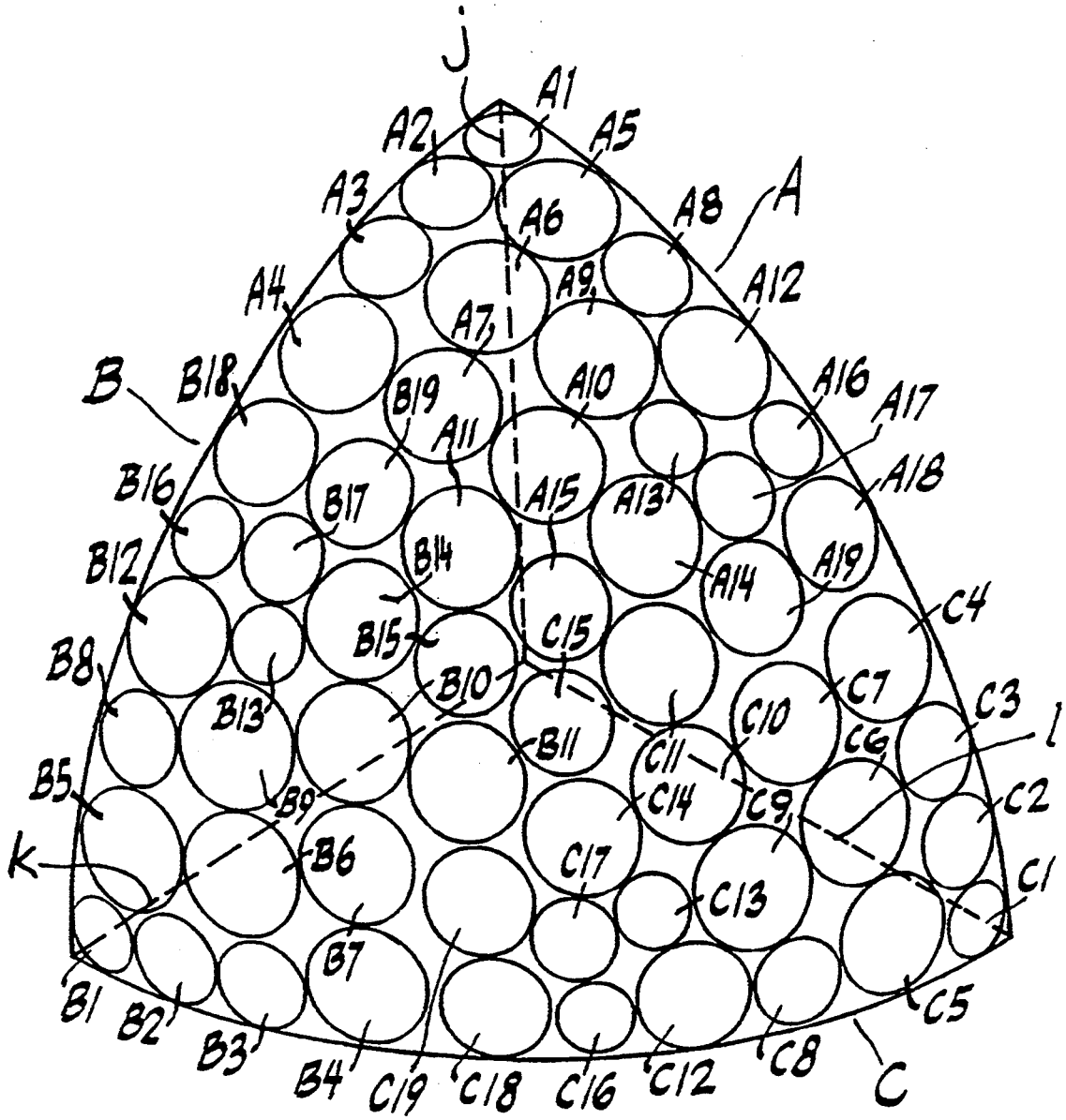
FIG. 4*a* is a view similar to FIG. 4 with dashed lines from center to apexes.

FIG. 3 shows quadrilaterals A, B and C. Quadrilateral A has sides a through d and dimples A1 through A19. The dimples are arranged so that none of them intersects sides a or d or extensions thereof, since these sides (a, d) lie along great circle parting lines. Dimples may intersect sides b or c, provided that their centers lie on side b or c. Dimples A4 and All intersect side c, and their centers lie on side c. Quadrilaterals B and C have the same dimple arrangement as A. When nested together as in FIG. 4, they form one of the spherical triangles 18*a–d* or 19*a–d*. Therefore, each triangle 18*a–d*, 19*a–d* composed of quadrilaterals A, B and C has 57 dimples and ball 10, with its eight (8) triangles has a total of 456 dimples. FIG. 4*a* illustrates the lack of bilateral symmetry across apex lines j, k and l. Bilateral symmetry across a line means that for each dimple or portion of a dimple on one side of such line there is a corresponding dimple or portion thereof on the other side of such line having the same size and shape and which is at the same orientation from the line.

Figure 5:
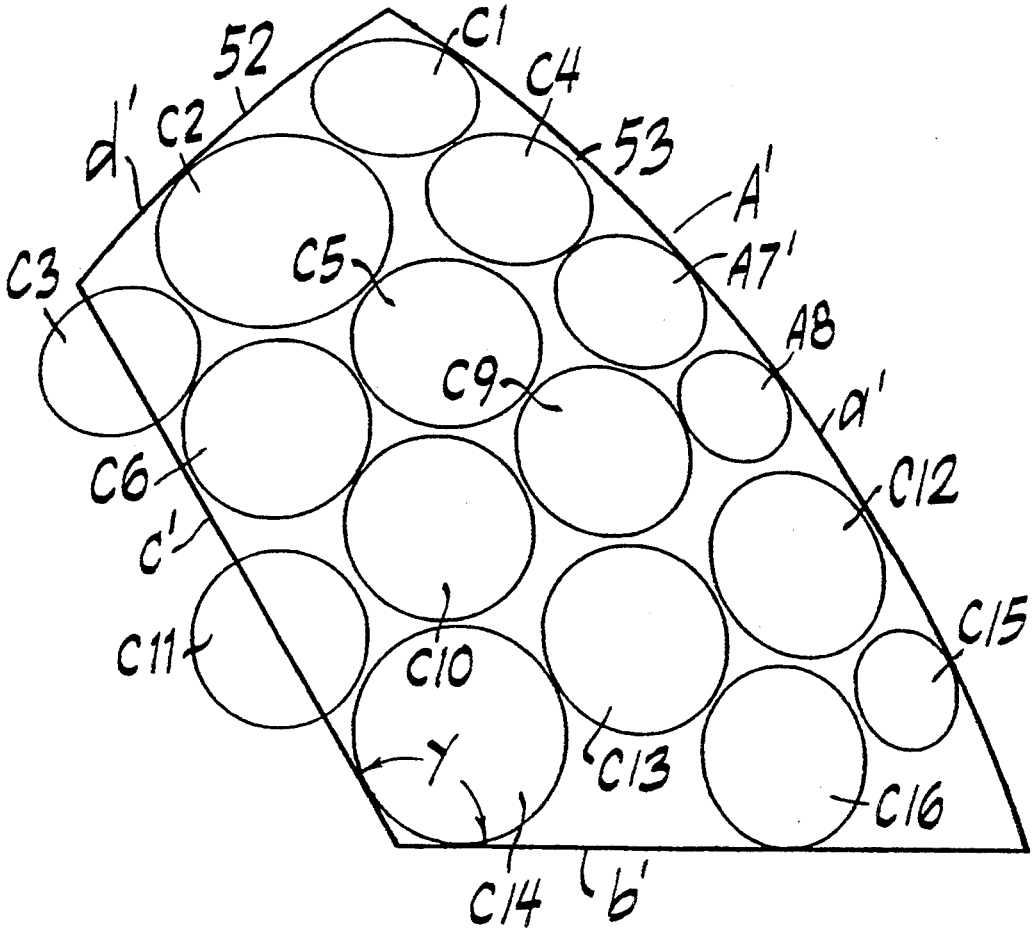
FIG. 5 is a dimpled quadrilateral of an alternative ball with 384 dimples.

Turning to FIG. 5, a quadrilateral of an alternative ball having 384 dimples of varying diameters is shown. The diameters are set forth in the following table:

TABLE II

| Number of Dimples | Dimple Diameter |
|---|---|
| 48 | .100 in. |
| 24 | .130 in. |
| 72 | .140 in. |
| 72 | .150 in. |
| 120 | .160 in. |
| 24 | .180 in. |
| 24 | .200 in. |

As in ball 10, this ball has three parting lines 52, 53 and 54 (not shown) and eight (8) triangles. Each triangle is divided into three quadrilaterals A′, B′ and C′ (the last two not shown). The dimples are arranged so that none of them intersects sides a′ or d's or extensions thereof.

Angle y between side b′ and side c′ is 120 degrees.

Figure 6:
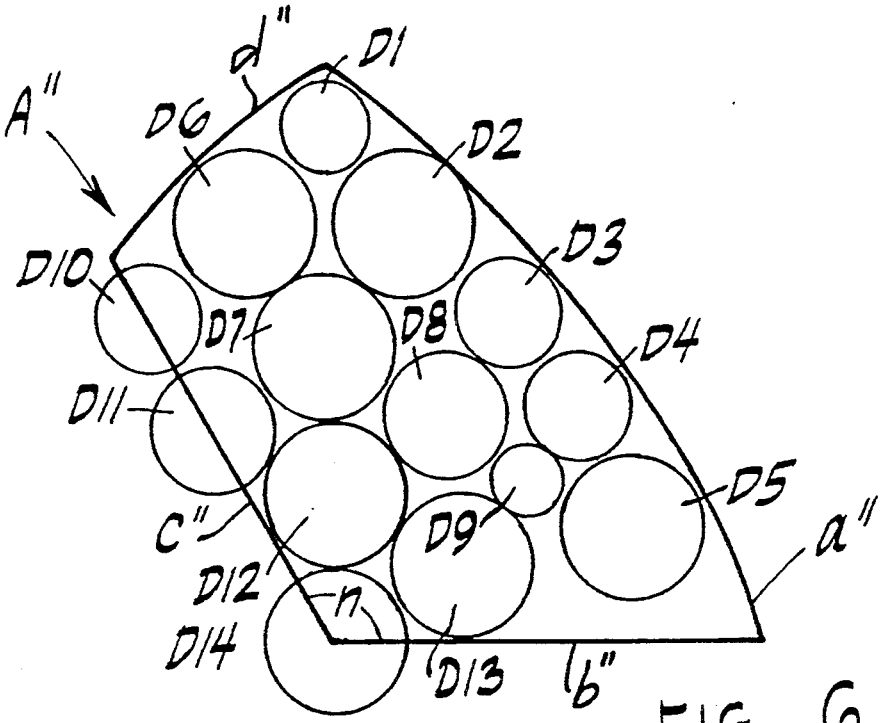
FIG. 6 is a quadrilateral of a third embodiment with dimples arranged therein.
Figure 7:
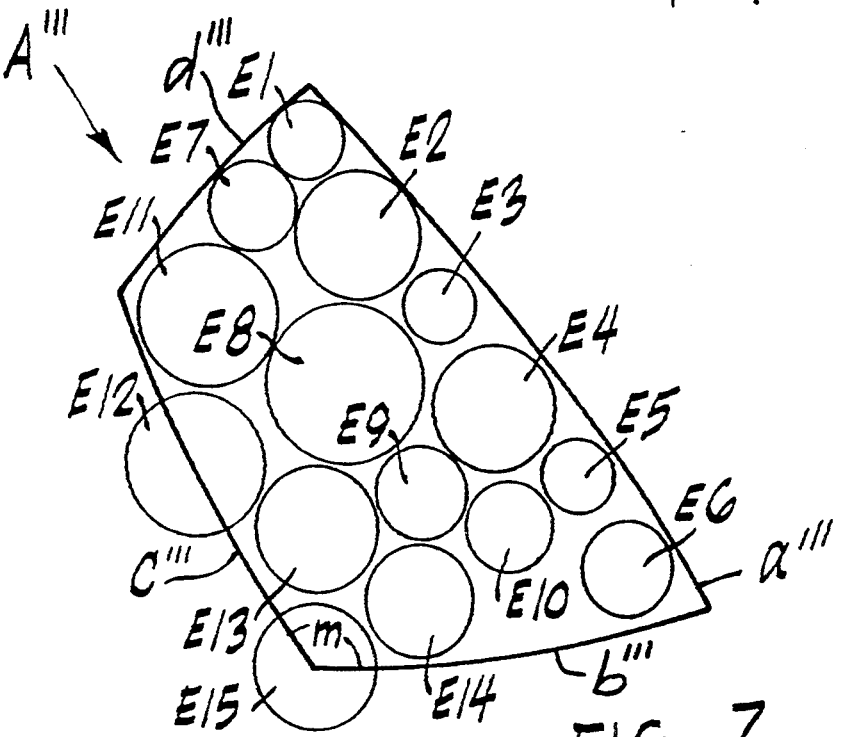
FIG. 7 is a quadrilateral of a further embodiment with dimples arranged therein.

Finally, turning to FIGS. 6 and 7, further embodiments are shown in which quadrilateral A″ and A‴ have side lines a″–d″ and a‴–d‴ respectively. Quadrilateral A″ has fourteen (14) dimples D1–14. Quadrilateral A‴ has fifteen (15) dimples E1–E15. Again quadrilaterals B″ and C″(not shown) are identical to A″ (except for apex dimple D14) and form spherical triangles in the same way as previous balls. And quadrilaterals B‴ and C‴ (not shown) are identical to A‴ (except for apex dimple E15) and form spherical triangles also in the same way as previous balls.

Angle n between side b″ and side c″ is 120 degrees and angle m between b‴ and c‴ is 120 degrees.

I claim:

1. A golf ball having a spherical surface with a plurality of dimples formed therein, the spherical surface comprising eight spherical triangles delineated by three great circle parting lines not intersecting any dimples, said parting lines being formed by projecting the edges of an inscribed regular octahedron onto said spherical surface, each of said triangles having dimples located within such parting lines such that a) the division of each triangle by three division lines angularly spaced at 120 degrees from one another and originating at the center of each triangle forms three spherical quadrilaterals each having identical dimple patterns; and b) each of said patterns is not bilaterally symmetrical across any apex line extending from the center of the triangle to an apex of the triangle.

2. The golf ball of claim 1 in which each spherical triangle has fifty seven dimples.

3. The golf ball of claim 2 in which six dimples in each spherical triangle intersect division lines.

4. The golf ball of claim 1 in which each spherical triangle has forty eight dimples.

5. The golf ball of claim 4 in which six dimples in each spherical triangle intersect division lines.

6. The golf ball of claim 1 in which division lines do not pass through dimples except certain dimples which such lines bisect or trisect.

* * * * *